US011280290B2

(12) United States Patent
Memain et al.

(10) Patent No.: US 11,280,290 B2
(45) Date of Patent: Mar. 22, 2022

(54) METHOD FOR CONTROLLING A FUEL PUMP FOR A MOTOR VEHICLE

(71) Applicants: CONTINENTAL AUTOMOTIVE FRANCE, Toulouse (FR); CONTINENTAL AUTOMOTIVE GmbH, Hannover (DE)

(72) Inventors: Jérémie Memain, Pinsaguel (FR); Sébastien Chiabo, Toulouse (FR); Guillaume Nantet, Leguevin (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 83 days.

(21) Appl. No.: 16/335,978

(22) PCT Filed: Sep. 22, 2017

(86) PCT No.: PCT/FR2017/052545
§ 371 (c)(1),
(2) Date: Mar. 22, 2019

(87) PCT Pub. No.: WO2018/055301
PCT Pub. Date: Mar. 29, 2018

(65) Prior Publication Data

US 2019/0264631 A1 Aug. 29, 2019

(30) Foreign Application Priority Data

Sep. 23, 2016 (FR) ..... 1658972

(51) Int. Cl.
*F02D 41/38* (2006.01)
*F02D 41/08* (2006.01)
(Continued)

(52) U.S. Cl.
CPC ..... *F02D 41/3845* (2013.01); *F02D 41/08* (2013.01); *F02D 41/1401* (2013.01);
(Continued)

(58) Field of Classification Search
CPC .. F02D 41/3845; F02D 41/08; F02D 41/1401; F02D 41/3809; F02D 2041/389;
(Continued)

(56) References Cited

U.S. PATENT DOCUMENTS 5,389,078 A * 2/1995 Zalesky ..... A61M 5/14526 604/151
6,866,025 B1 * 3/2005 Maass ..... F04B 49/246 123/179.17
(Continued)

FOREIGN PATENT DOCUMENTS

DE 10 2011 112947 B3 12/2012
FR 2781013 A1 1/2000
(Continued)

OTHER PUBLICATIONS

International Search Report, dated Apr. 16, 2018, from corresponding PCT application No. PCT/FR2017/052545.

*Primary Examiner* — David Hamaoui
(74) *Attorney, Agent, or Firm* — Nixon & Vanderhye

(57) ABSTRACT

Disclosed is a method for controlling a fuel pump for a motor vehicle, including determining if a set amount of fuel to be compressed is less than the minimum volume that can be delivered by the pump and, if this is the case, determining a new set amount of fuel to be compressed equal to the product of a number of compressions of a volume equal to the set amount of fuel to be compressed required to achieve at least the minimum volume that can be delivered and the set amount of fuel to be compressed; transmitting the new set amount of fuel to be compressed to the fuel pump; and
(Continued)

subsequently disabling the fuel pump for a number of occurrences of the set amount of fuel equal to the number of compressions of a volume equal to the set amount of fuel to be compressed.

6 Claims, 1 Drawing Sheet

(51) Int. Cl.

| | |
|---|---|
| ***F02D 41/14*** | (2006.01) |
| ***F02M 59/02*** | (2006.01) |
| ***F02M 59/20*** | (2006.01) |
| ***F02M 63/02*** | (2006.01) |
| ***F04B 1/00*** | (2020.01) |
| ***F04B 49/06*** | (2006.01) |
| ***F04B 1/02*** | (2006.01) |

(52) U.S. Cl.
CPC ..... *F02D 41/3809* (2013.01); *F02M 59/02* (2013.01); *F02M 59/20* (2013.01); *F02M 63/0265* (2013.01); *F04B 1/00* (2013.01); *F04B 1/02* (2013.01); *F04B 49/065* (2013.01); *F02D 2041/389* (2013.01); *F04B 2205/09* (2013.01)

(58) Field of Classification Search
CPC .. F04B 1/02; F04B 1/00; F04B 49/065; F04B 2205/09; F04B 49/20; F02M 59/02; F02M 59/20; F02M 63/0265
See application file for complete search history.

(56) References Cited

U.S. PATENT DOCUMENTS

| | | | | |
|---|---|---|---|---|
| 7,059,302 | B2 * | 6/2006 | Lemoure | F02D 41/3082 123/446 |
| 7,270,113 | B2 | 9/2007 | Hervault et al. | |
| 8,812,215 | B2 * | 8/2014 | Sugiyama | F02D 41/3845 123/446 |
| 9,989,017 | B2 * | 6/2018 | Foege | F02D 41/3082 |
| 2005/0252492 | A1 | 11/2005 | Hervault et al. | |
| 2012/0215422 | A1 | 8/2012 | Sugiyama et al. | |

FOREIGN PATENT DOCUMENTS

| | | | |
|---|---|---|---|
| JP | 2013185897 | A * | 9/2013 |
| WO | 2004/007950 | A2 | 1/2004 |

* cited by examiner

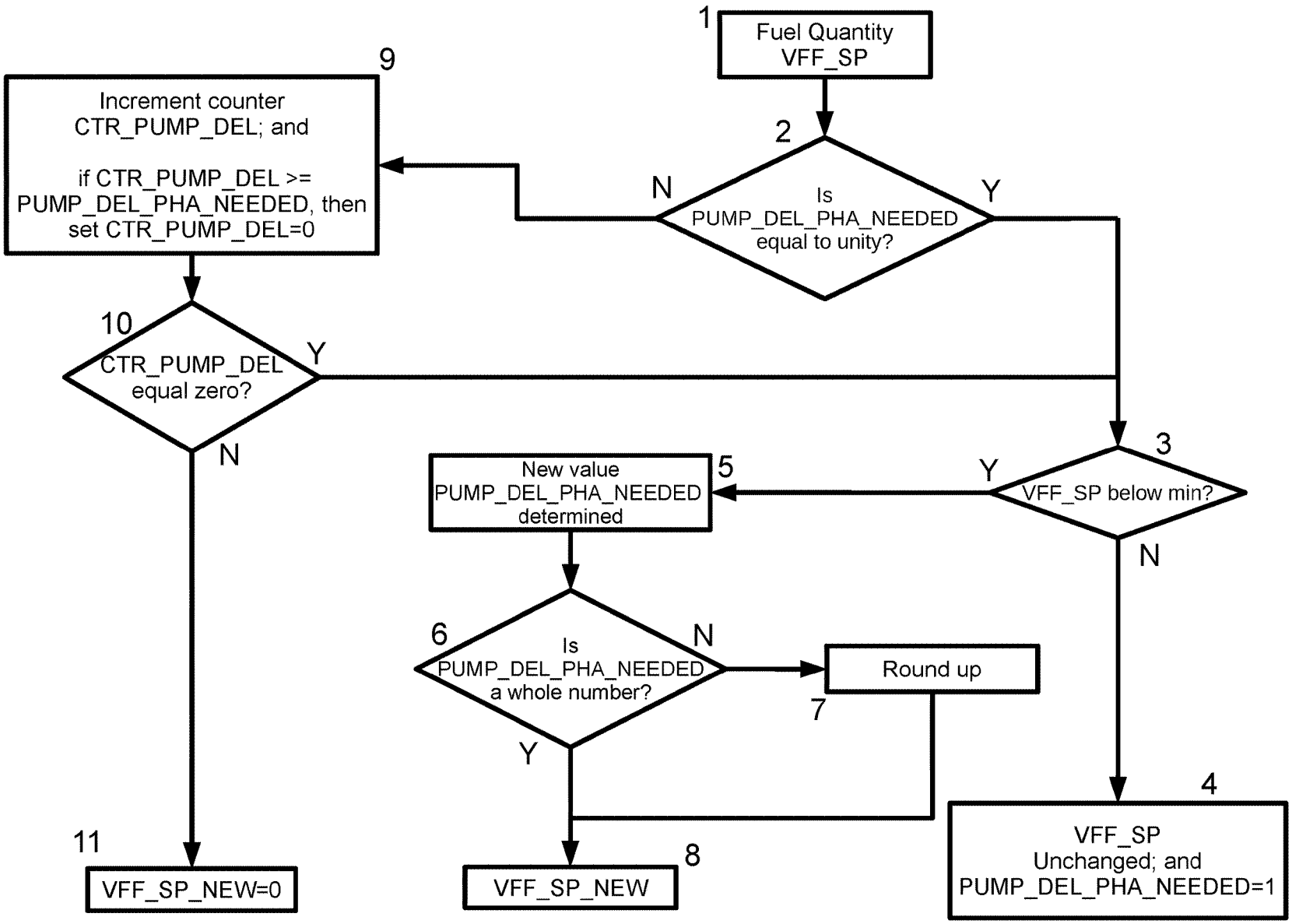
1
Fuel Quantity
VFF_SP
2
Is
PUMP_DEL_PHA_NEEDED
equal to unity?
Y
N
3
VFF_SP below min?
Y
N
4
VFF_SP
Unchanged; and
PUMP_DEL_PHA_NEEDED=1
5
New value
PUMP_DEL_PHA_NEEDED
determined
6
Is
PUMP_DEL_PHA_NEEDED
a whole number?
N
Y
7
Round up
8
VFF_SP_NEW
9
Increment counter
CTR_PUMP_DEL; and
if CTR_PUMP_DEL >=
PUMP_DEL_PHA_NEEDED, then
set CTR_PUMP_DEL=0
10
CTR_PUMP_DEL
equal zero?
Y
N
11
VFF_SP_NEW=0

METHOD FOR CONTROLLING A FUEL PUMP FOR A MOTOR VEHICLE

The technical field of the invention is the control of motor vehicle fuel pumps and, more particularly, the control of such pumps outside of their specifications.

BACKGROUND OF THE INVENTION

Internal combustion engines comprise cylinders in which controlled combustion takes place. This combustion is said to be controlled because the quantity of fuel and of air admitted are determined, in order to satisfy the required operation of the vehicle.

In present-day vehicles, the fuel is admitted to the cylinders by injectors, notably supplied by a common rail. This common rail is pressurized with fuel by a fuel pump pumping fuel from the fuel tank of the vehicle.

Such a fuel pump is generally rated to be able to supply the various quantities of fuel needed both during steady-state operation and under transient conditions.

However, in certain phases of operation, notably at low idle, the quantities of fuel that need to be compressed are greatly reduced. Bearing in mind the advances made in engine design and control within the field of fuel consumption, the quantities of fuel to be compressed may become so low as to fall below the minimum quantity that the commercially available fuel pumps are able to compress.

Under such conditions, either more fuel than is needed is compressed in order to satisfy the operating conditions of the fuel pumps available, or the required quantity of fuel to be compressed falls below the minimum quantity that the pump is able to compress, thereby leading to significant spread in the amounts of fuel actually admitted.

In both instances, it is found that more fuel than is needed is admitted, thereby increasing the cost of operation and the ecological cost of the vehicles affected.

There is still a problem with controlling fuel pumps when the volume that is to be compressed is below the minimum compressible volume.

Known from the prior art is document WO 2004-07950 which describes how to control small deliveries from a high-pressure pump by providing a hardware solution that consists in introducing a leakage path by changing a component so that the volume control valve VCV acts on a higher delivery.

SUMMARY OF THE INVENTION

The subject of the invention is a method for controlling the fuel pump for a motor vehicle, the fuel pump being able to deliver a minimal volume of fuel.

The method comprises the following steps: for each iteration

- a demand for a demanded quantity of fuel to be compressed is received,
- it is determined whether the demanded quantity of fuel to be compressed is below the minimum volume that the pump is capable of delivering,
  - if it is not, the demand for a demanded quantity of fuel to be compressed is transmitted to the fuel pump,
  - if it is, a number of compressions of a volume equal to the demanded quantity of fuel to be compressed that are needed in order to reach at least the minimum volume that the pump is capable of delivering is determined, this being equal to the minimum volume that the pump is capable of delivering divided by the demanded quantity of fuel to be compressed,
- a new demanded quantity of fuel to be compressed is determined as being equal to the product of the number of compressions of a volume equal to the demanded quantity of fuel to be compressed times the demanded quantity of fuel to be compressed,
- the demanded quantity of fuel to be compressed is replaced by the new demanded quantity of fuel to be compressed,
- the demand for a new demanded quantity of fuel to be compressed is transmitted to the fuel pump, then
- the fuel pump is inhibited for a number of occurrences of the demand for fuel that is equal to the number of compressions of a volume equal to the demanded quantity of fuel to be compressed.

In order to inhibit the fuel pump for a number of occurrences of the demand for fuel equal to the number of compressions of a volume equal to the demanded quantity of fuel to be compressed in the current iteration, after having determined that the demanded quantity of fuel to be compressed is below the minimum volume that the pump is capable of delivering, and after having replaced the demanded quantity of fuel to be compressed by the new demanded quantity of fuel to be compressed:

- a condition may be set that a counter of the number of phases of compression of the pump which are needed in order to achieve at least the minimum volume that the pump is capable of delivering with the demanded quantity of fuel to be compressed is equal to zero, and then
- in the next iteration, having determined the demanded quantity of fuel to be compressed, the value of the counter of the number of phases of compression of the pump that are needed in order to achieve at least the minimum volume that the pump is capable of delivering with the demanded quantity of fuel to be compressed can be incremented by one unit and the method can then determine whether the value of the counter of the number of phases of compression of the pump that are needed in order to achieve at least the minimum volume that the pump is capable of delivering with the demanded quantity of fuel to be compressed thus obtained is lower than the number of compressions of a volume equal to the demanded quantity of fuel to be compressed,
  - if it is not, then the value of the counter of the number of compression phases of the pump that are needed in order to achieve at least the minimum volume that the pump is capable of delivering with the demanded quantity of fuel to be compressed can be canceled and the method can continue by comparing the demanded quantity of fuel to be compressed against the minimum volume that the pump is capable of delivering,
  - if it is, then the value of the counter of the number of compression phases of the pump that are needed in order to achieve at least the minimum volume that the pump is capable of delivering with the demanded quantity of fuel to be compressed can be maintained and
  - a demand for a new demanded quantity of fuel to be compressed that is equal to zero can be defined and transmitted to the pump.

When the pump is of the type having at least two plungers, it is possible to transmit the demand for a demanded quantity of fuel to be compressed always to the one same plunger.

When the pump is of the type having at least two plungers, it is possible to transmit each demand for a non-zero demanded quantity of fuel to be compressed to different plungers.

BRIEF DESCRIPTION OF THE DRAWINGS

Other objects, features and advantages of the invention will become apparent from reading the following description, given solely by way of nonlimiting example and made with reference to the attached drawing in which the single FIGURE illustrates the main steps in the method for controlling a fuel pump according to the invention.

DETAILED DESCRIPTION OF THE PREFERRED EMBODIMENTS

The method described hereinbelow is executed in a control loop, the values from the previous iteration being used as initialization values for the current iteration.

For the first iteration, the method is initialized using a counter CTR_PUMP_DEL of the number of pump compression phases needed in order to achieve at least the minimum volume VFF_Pump_Min that the pump is capable of delivering with the demanded quantity of fuel to be compressed equal to zero, and a number PUMP_DEL_PHA_NEEDED of compressions of a volume equal to the demanded quantity of fuel to be compressed equal to unity.

During a first step 1, the demanded quantity of fuel to be compressed VFF_SP is received for example from a control unit of the internal combustion engine.

During a second step 2, the method determines whether the number PUMP_DEL_PHA_NEEDED of compressions of a volume equal to the demanded quantity of fuel to be compressed in order to achieve the minimum volume VFF_Pump_Min that the pump is capable of delivering is equal to unity.

If it is, then the method continues to a third step 3 during which it determines whether the demanded quantity of fuel to be compressed VFF_SP is below the minimum volume VFF_Pump_Min that the pump is capable of delivering.

If it is not, then the method continues to a fourth step 4, during which the demanded quantity of fuel to be compressed VFF_SP is left unchanged, the number PUMP_DEL_PHA_NEEDED of compressions of a volume equal to the demanded quantity of fuel to be compressed in order to achieve the minimum volume VFF_Pump_Min that the pump is capable of delivering is set equal to 1 and the counter CTR_PUMP_DEL of the number of compression phases of the pump that are needed in order to achieve at least the minimum volume VFF_Pump_Min that the pump is capable of delivering with the demanded quantity of fuel to be compressed is set equal to zero.

In other words, during the fourth step 4 the method determines that the volume to be compressed is above the limit of the minimal volume that the pump is capable of compressing. That being so, the entirety of the volume that is to be compressed can be handled by the pump with no loss of precision.

If, at the end of the third step 3, the demanded quantity of fuel to be compressed VFF_SP is below the minimum volume VFF_Pump_Min that the pump is capable of delivering, the method continues with a fifth step 5 during which a new value for the number PUMP_DEL_PHA_NEEDED of compressions of a volume equal to the demanded quantity of fuel to be compressed needed in order to achieve at least the minimum volume VFF_Pump_Min that the pump is capable of delivering is determined by dividing the minimum volume VFF_Pump_Min that the pump is capable of delivering by the demanded quantity of fuel that is to be compressed VFF_SP.

During a sixth step 6, the method determines whether the number PUMP_DEL_PHA_NEEDED of compressions of a volume equal to the demanded quantity of fuel to be compressed is a whole number.

If it is not, then the number PUMP_DEL_PHA_NEEDED of compressions of a volume equal to the demanded quantity of fuel to be compressed is rounded up to the integer above during a seventh step 7.

At the end of steps 6 or 7, the method continues with an eighth step 8 during which a new demanded quantity of fuel to be compressed VFF_SP_NEW is determined, this being equal to the product of the number PUMP_DEL_PHA_NEEDED of compressions of a volume equal to the demanded quantity of fuel to be compressed times the demanded quantity of fuel to be compressed VFF_SP. The demanded quantity of fuel to be compressed VFF_SP is replaced by the new demanded quantity of fuel to be compressed VFF_SP_NEW. The counter CTR_PUMP_DEL of the number of phases of compression of the pump which are needed in order to achieve at least the minimum volume VFF_Pump_Min that the pump is capable of delivering with the demanded quantity of fuel to be compressed is set equal to zero.

In other words, during the eighth step 8, the method determines that the current demanded quantity of fuel to be compressed VFF_SP is lower than the minimum volume VFF_Pump_Min that the pump is capable of delivering, and cannot therefore be compressed with satisfactory precision. The method then determines how many iterations of the quantity of fuel to be compressed VFF_SP are needed in order to achieve the minimum volume VFF_Pump_Min that the pump is capable of delivering. This value is rounded up to the value above and transmitted to the pump in the form of a new demand. On receipt of this new demand, the pump will thus in a single shot compress the equivalent of several times the current demanded quantity of fuel to be compressed VFF_SP, which is a quantity that can be compressed with precision because it is higher than the minimum volume VFF_Pump_Min that the pump is capable of delivering.

During the next occurrence of the method, it will be determined that the number PUMP_DEL_PHA_NEEDED of compressions of the volume equal to the demanded quantity of fuel to be compressed is higher than unity, and that no compression needs to be performed on this occasion. Because no compression needs to be performed, the demand for a demanded quantity of fuel to be compressed VFF_SP, although received, is not acted upon. That is the purpose of steps 9 to 11 of the method, which will now be described.

If, at the end of step 2, the method has determined that the number PUMP_DEL_PHA_NEEDED of compressions of a volume equal to the demanded quantity of fuel to be compressed in order to achieve the minimum volume VFF_Pump_Min that the pump is capable of delivering is not equal to unity, the method continues with a ninth step 9. During the ninth step 9, the value of the counter CTR_PUMP_DEL of the number of phases of compression of the pump that are needed in order to achieve at least the minimum volume VFF_Pump_Min that the pump is capable of delivering with the demanded quantity of fuel to be compressed is incremented by one unit and the method determines whether the value of the counter CTR_PUMP_DEL of the number of phases of compression of the pump that are needed in order to achieve at least the minimum volume VFF_Pump_Min that the pump is capable of delivering with the demanded quantity of fuel to be compressed thus obtained is lower than the number PUMP_DEL_PHA_NEEDED of compressions of a volume equal to the demanded quantity of fuel to be compressed. If it is not, then the value of the counter CTR_PUMP_DEL of the number of compression phases of the pump that are needed in order to achieve at least the minimum volume VFF_Pump_Min that the pump is capable of delivering with the demanded quantity of fuel to be compressed is canceled.

During a tenth step 10, the method determines whether the value of the counter CTR_PUMP_DEL of the number of phases of compression of the pump which are needed in order to achieve at least the minimum volume VFF_Pump_Min that the pump is capable of delivering with the demanded quantity of fuel to be compressed is equal to zero.

If it is, the method continues at step 3 described above.

If it is not, the method continues with an eleventh step 11 during which a new demanded quantity of fuel to be compressed VFF_SP_NEW, equal to zero, is defined, and the demanded quantity of fuel to be compressed VFF_SP is replaced with the new demanded quantity of fuel to be compressed VFF_SP_NEW.

In other words, during step 9, the counter CTR_PUMP_DEL of the number of phases of compression of the pump is incremented by one unit up to an amount not exceeding the number PUMP_DEL_PHA_NEEDED of compressions of a volume equal to the demanded quantity of fuel to be compressed as determined during a previous iteration. If the counter CTR_PUMP_DEL of the number of phases of compression of the pump becomes higher than the number PUMP_DEL_PHA_NEEDED of compressions of a volume equal to the demanded quantity of fuel to be compressed, that fact leads to the deduction that the present occurrence of the demanded quantity of fuel to be compressed VFF_SP is not covered by the latest compression of fuel. The counter CTR_PUMP_DEL of the number of phases of compression of the pump is then reset to zero, the method continuing at step 3.

In other cases, that means that the demanded quantity of fuel to be compressed VFF_SP is covered by the latest compression of fuel. The demanded quantity of fuel to be compressed VFF_SP is set to zero so that no compression of fuel is performed.

At the end of steps 4, 8 and 11, the method ends with the emission of a demand for a demanded quantity of fuel to be compressed VFF_SP, which is sent to the actuator of the fuel pump.

The control method described hereinabove is applicable to single-plunger or multi-plunger compression pumps. In the case of multi-plunger pumps, the demand for a demanded quantity of fuel to be compressed at the end of steps 4 and 8 can be sent to a single plunger or to a different plunger each time a demand is issued.

The invention claimed is:

1. A method for controlling a fuel pump for a motor vehicle, the method comprising:

for each iteration:

receiving a demand for a demanded quantity of fuel to be compressed by the pump;

determining whether the demanded quantity of fuel is greater than zero and below a minimum volume that the pump is capable of delivering;

if by said determining, the demanded quantity of fuel is determined to be not below the minimum volume that the pump is capable of delivering, transmitting the demand for the demanded quantity of fuel to the fuel pump; and if by said determining, the demanded quantity of fuel is determined to be greater than zero and below the minimum volume that the pump is capable of delivering:

determining a number of compressions of a volume equal to the demanded quantity of fuel that are needed in order to reach at least the minimum volume that the pump is capable of delivering, said number of compressions being equal to the minimum volume that the pump is capable of delivering divided by the demanded quantity of fuel, determining a new demanded quantity of fuel to be compressed as being equal to a product of said number of compressions times the demanded quantity of fuel, replacing the demanded quantity of fuel with the new demanded quantity of fuel, transmitting a demand for the new demanded quantity of fuel to the fuel pump, and then preventing compression at the fuel pump by inhibiting the fuel pump from receiving a number of subsequent occurrences of non-zero demands for fuel, said number equal to said number of compressions minus one, wherein, in said determining said number of compressions, if said number of compressions is not a whole number, a further step takes place of rounding said number of compressions to an integer above the minimum volume that the pump is capable of delivering divided by the demanded quantity of fuel.

2. The control method as claimed in claim 1, wherein, for inhibiting the fuel pump from receiving the number of subsequent occurrences of demand for fuel:

after said determining that the demanded quantity of fuel is below the minimum volume that the pump is capable of delivering, and after said replacing the demanded quantity of fuel with the new demanded quantity of fuel, setting a counter with a value equal to zero; and then in a next iteration, having received a next demand for a next demanded quantity of fuel to be compressed, incrementing the value of the counter by one unit, and a determination is carried out whether the value of the counter thus obtained is lower than said number of compressions, where if, by said determination, the value of the counter is not lower than said number of compressions, then the value of the counter is canceled and the method continues by comparing the next demanded quantity of fuel to be compressed against the minimum volume that the pump is capable of delivering; and if, by said determination, the value of the counter is lower than said number of compressions, then the value of the counter is maintained, and a new demand of a new demanded quantity of fuel to be compressed, having a value of zero, is defined and transmitted to the pump.

3. The control method as claimed in claim 1, wherein the pump is of the type having at least two plungers, and the demand for a demanded quantity of fuel to be compressed is transmitted always to one same plunger of said at least two plungers.

4. The control method as claimed in claim 1, wherein the pump is of the type having at least two plungers, and each demand for a non-zero demanded quantity of fuel to be compressed is transmitted to alternate ones of said at least two plungers.

5. The control method as claimed in claim 2, wherein the pump is of the type having at least two plungers, and the demand for a demanded quantity of fuel to be compressed is transmitted always to one same plunger of said at least two plungers.

6. The control method as claimed in claim 2, wherein the pump is of the type having at least two plungers, and each demand for a non-zero demanded quantity of fuel to be compressed is transmitted to alternate ones of said at least two plungers.

* * * * *